US007399916B1

(12) United States Patent
Lombardi

(10) Patent No.: US 7,399,916 B1
(45) Date of Patent: Jul. 15, 2008

(54) PERCUSSION COW-BELL HOLDER APPARATUS

(75) Inventor: Donald G Lombardi, Westlake Village, CA (US)

(73) Assignee: Drum Workshop, Inc., Oxnard, CA (US)

( * ) Notice: Subject to any disclaimer, the term of this patent is extended or adjusted under 35 U.S.C. 154(b) by 78 days.

(21) Appl. No.: 11/586,082

(22) Filed: Oct. 26, 2006

(51) Int. Cl.
*G10D 13/02* (2006.01)

(52) U.S. Cl. ..... 84/422.1

(58) Field of Classification Search ..... 84/411 R, 84/422.1, 422.2, 422.3, 402, 403, 404
See application file for complete search history.

(56) References Cited

U.S. PATENT DOCUMENTS 6,559,368 B1 * 5/2003 Sikra et al. ..... 84/421

* cited by examiner

*Primary Examiner*—Kimberly R Lockett
(74) *Attorney, Agent, or Firm*—William W. Haefliger

(57) ABSTRACT

Percussion instrument support apparatus, comprising in combination, a base, an upright stand pivotally supported on the base to a first position, a brace releasably connected to the base at a second position apart from the first position, the brace pivotally connected to the stand, whereby when the stand is swung to down position relative to the base, the brace is released from the base and is swung to a down position relative to the base.

13 Claims, 6 Drawing Sheets

PERCUSSION COW-BELL HOLDER APPARATUS

BACKGROUND OF THE INVENTION

This invention relates generally to drumming associated equipment, and more particularly to adjustable apparatus for supporting percussion instruments, for example to allow ready collapse of the apparatus from sturdy upright position, for transport purposes.

There is continued need for apparatus of the above type, and more particularly there is need for improved apparatus that accommodates to both collapse of the apparatus from extended condition, and adjustment of the apparatus in extended upright condition, such as height adjustment of the percussion instrument, and also to provision for carriage of at least two percussion instruments, in extended condition of the apparatus. There is also need for particular apparatus as disclosed herein, having unusual advantages in structure, modes of operation and results, as will be seen.

SUMMARY OF THE INVENTION

It is a major object of the invention to provide improved apparatus, meeting the above needs. Basically, the apparatus comprises:

a) a base, b) an upright stand pivotally supported on the base at a first position, c) a brace releasably connected to the base, at a second position offset from the first position, the brace pivotally connected at the stand, d) whereby when the stand is swung to down position relative to the base, the brace is released from the base and is swung oppositely to a down position relative to the base.

As will be seen, the brace and stand typically extend in side-by-side relation, generally horizontally, in said down positions; and the brace preferably has two legs respectively extending at opposite sides of the stand, in said down position, for stability and for crossing over the stand, when swung. Also the brace typically has a releasable connection at an end thereof to releasably connect to the base.

Another object includes provision of a holder or holders carried on upper extent or extents of the stand, to releasably hold a percussion instrument, or instruments, so as to enable their release during collapse of the stand and brace, as referred to, and also to enable their adjustment such as height adjustment, during instrument support. One such instrument is a cow bell, and another is a drumming practice pad.

Another object is to position the apparatus in close operative relation to a foot operated beater, swingable to selectively strike one of the percussion instruments, such as a cow bell or a plastic pad, in their adjusted height position.

These and other objects and advantages of the invention, as well as the details of an illustrative embodiment, will be more fully understood from the following specification and drawings, in which:

DRAWING DESCRIPTION

DETAILED DESCRIPTION

Figure 1:
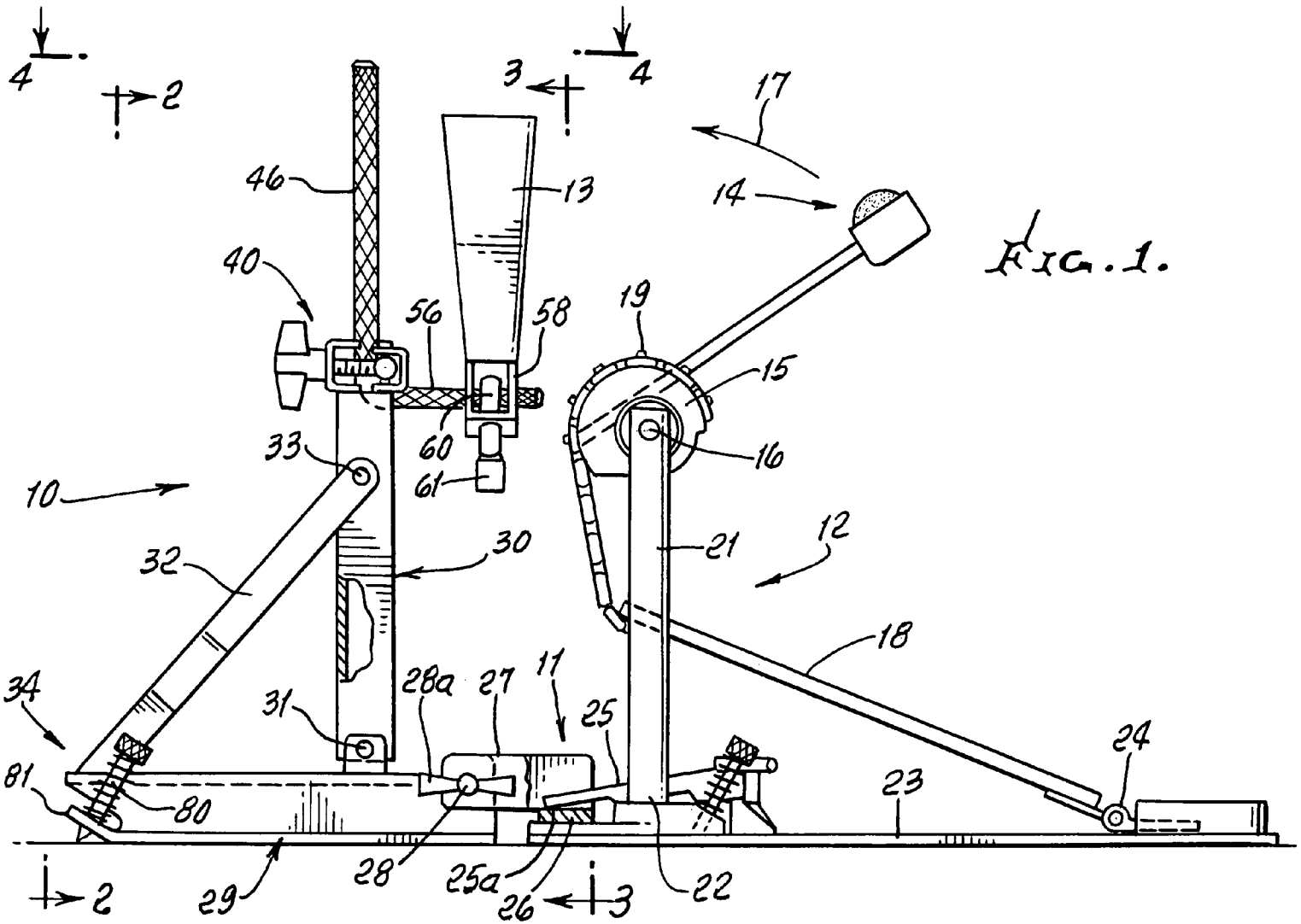
FIG. 1 is a side elevation showing percussion instrument support apparatus, and foot operative beater advantages, i.e. a pedal unit 11, coupled to the support apparatus, for beater striking of the percussion instrument.

In FIG. 1, percussion instrument support apparatus 10 is shown coupled at 11 to a drum beater unit 12, in position for beating of the percussion instrument 13, such as an upright cow bell, by the beater 14. The latter is carried on a rotor 15 mounted on an axle 16 for rotation (see arrow 17) in response to foot depression of a pedal 18 coupled to the sprocket teeth 19 on the rotor 15, or on an associated rotor. A suitable spring return is also provided (see U.S. Pat. No. 5,204,485 incorporated herein by reference). Axle 16 is mounted by suitable bearings on two pedestals 21 mounted at 22 to a horizontal base 23. A pedal pivot is provided at 24. A hold down jaw 25 (are coupling devices) clamps at 25*a* onto a part 26 on a carrier 27 adjustably pivotally supported at 28 on a base 29 of apparatus 10. Tightenable handles 28*a* clamp the connection 28 to hold part 26 at selected elevation to be clasped by jaw 25.

Figure 6:
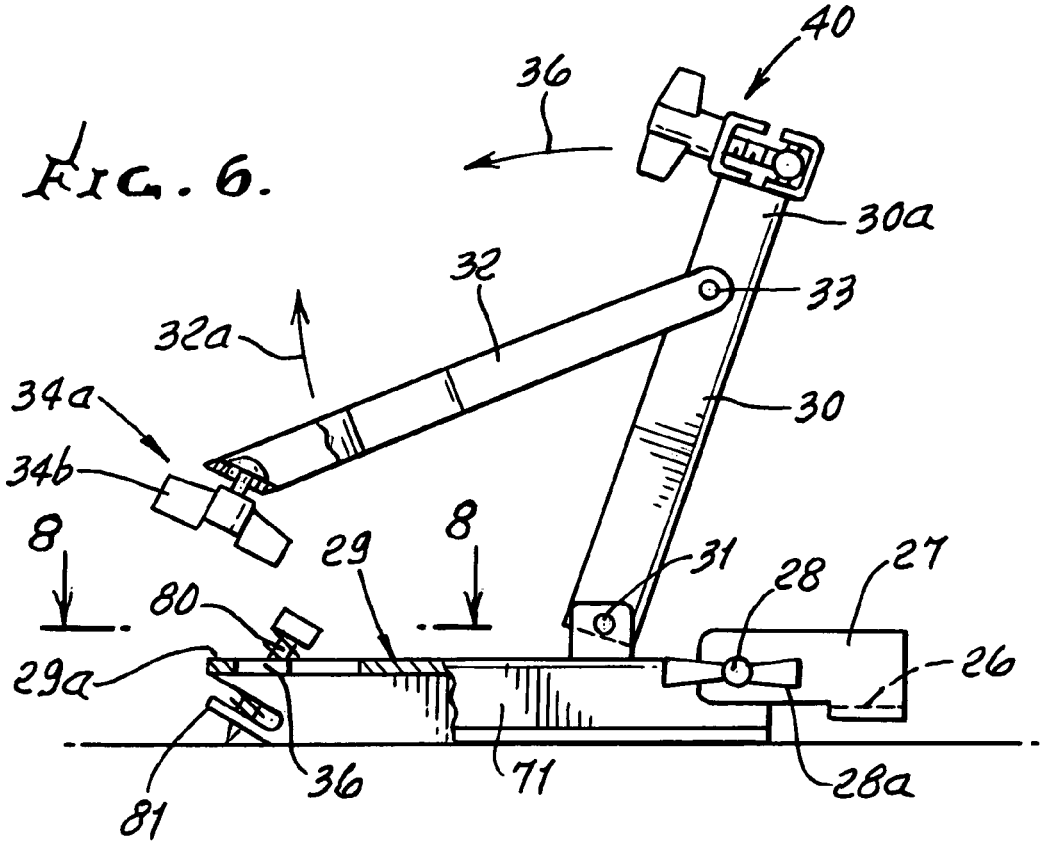
FIG. 6 is a side elevation of the percussion instrument support apparatus, as in FIG. 1, except that elements are shown during partly pivoting from playing (extended) position to collapsed (travel) position.
Figure 7:
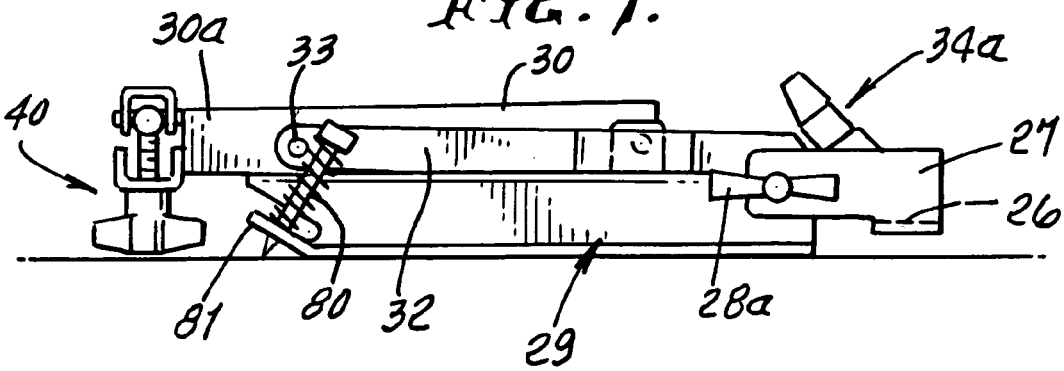
FIG. 7 is a view like FIG. 6, except that the elements are shown in fully collapsed position.

Apparatus 10 includes the following, in combinations a) a stand and base, (see for example stand 30 pivotally supported at 31 on base 29), b) an upright stand pivotally supported on the base at a first position, (see for example angled brace strut 32 pivotally connected at 33 to the stand 30, and releasably coupled at 34 to the base 29), c) whereby when the stand is swung to down position relative to the base, the brace is released from the base and is swung to down position, (see for example counterclockwise swinging of the stand FIG. 6, indicated by arrow 36, and clockwise swinging of the brace strut 32 (see arrow 32*a*) to pass sidewardly of and over the top portion 30*a* of the stand, these elements then swinging downwardly to collapsed, condensed positions, as shown in FIG. 7, as for travel or transport).

FIG. 7 also shows the stand 30 extending horizontally in side-by-side relation with the strut 32, which has two parallel legs 32. See such legs in FIG. 10. Collapsed elements 30 and 32 extend adjacent the base 29, as seen in FIG. 7. Legs 32 are spaced to pass at opposite sides of the stand, during swinging.

Figure 3:
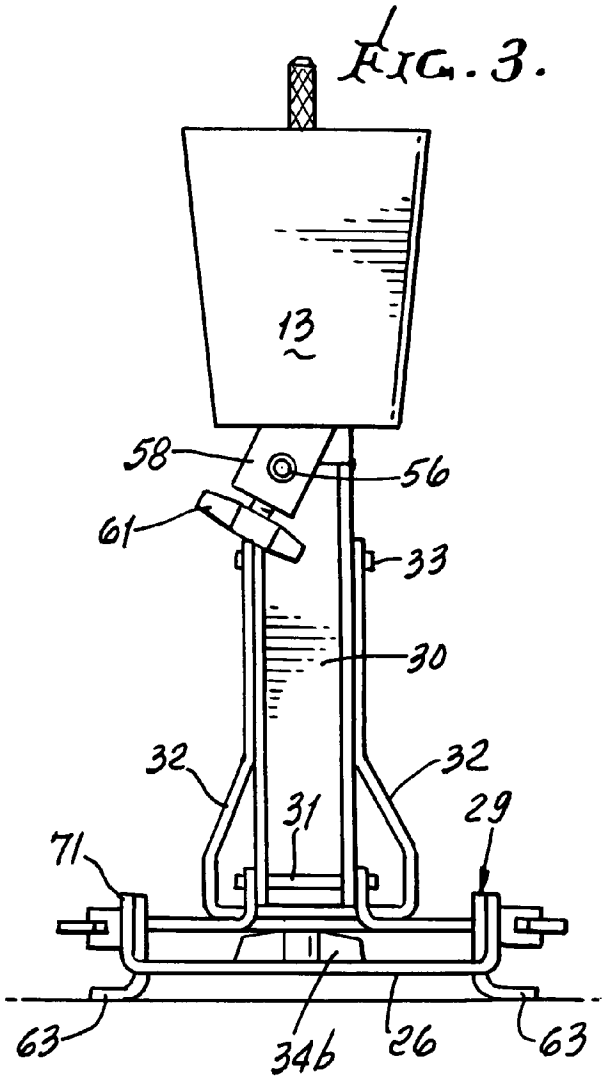
FIG. 3 is an elevation view taken on lines 3-3 of FIG. 1.
Figure 2:
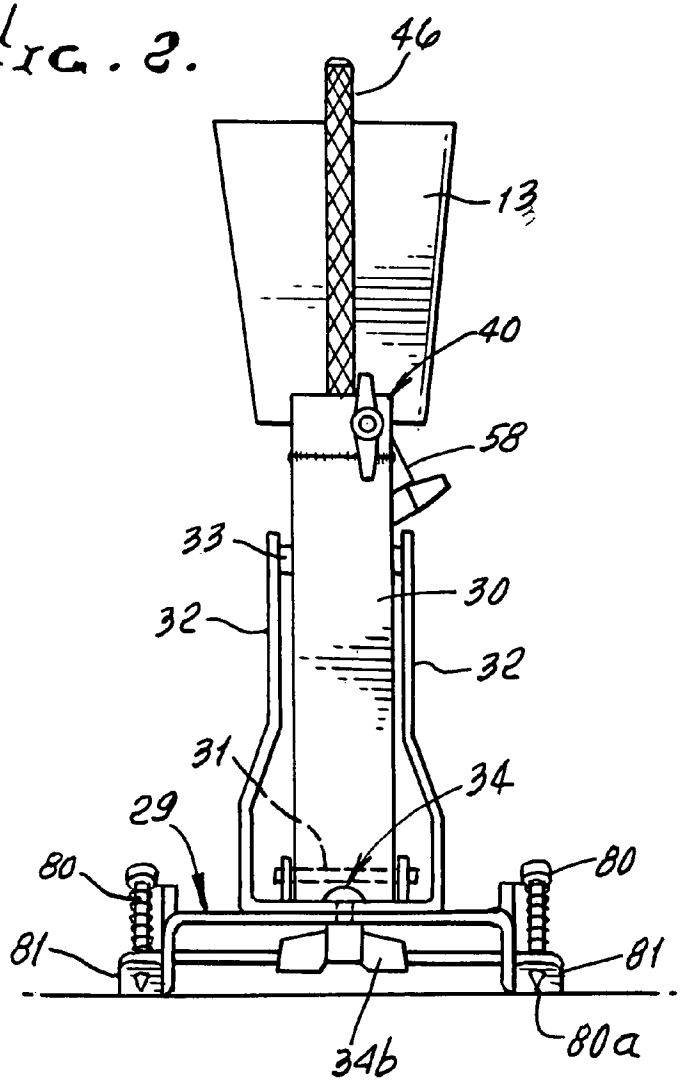
FIG. 2 is a frontal elevation view taken on lines 2-2 of FIG. 1.
Figure 4:
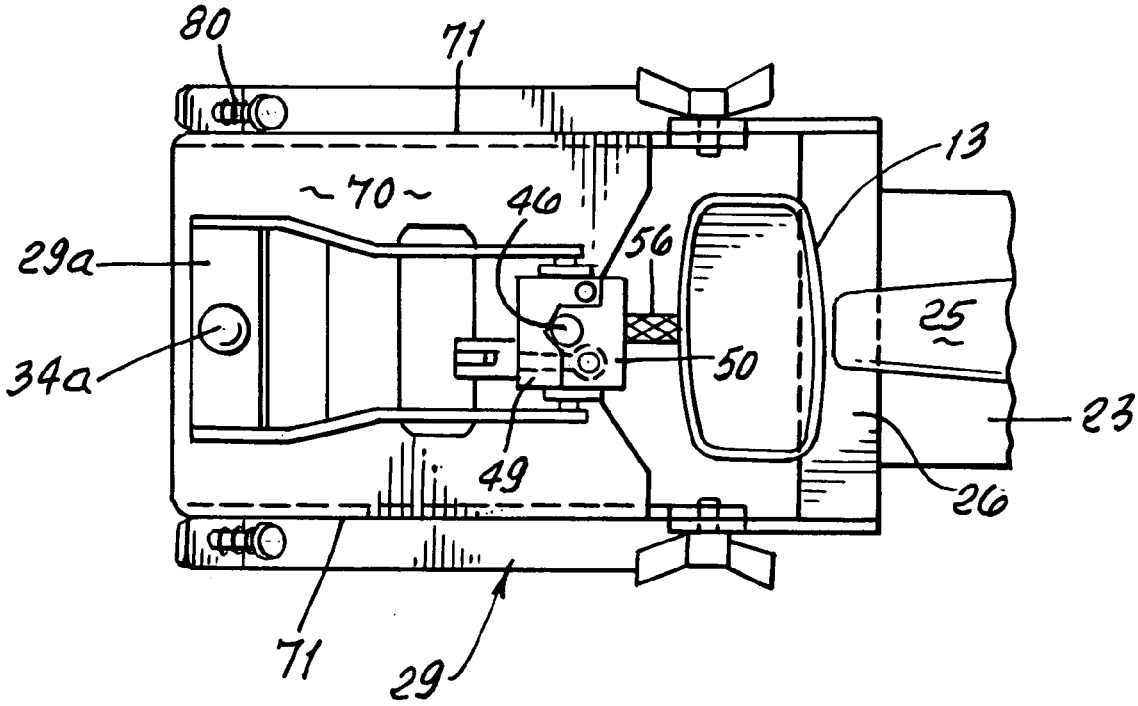
FIG. 4 is a top plan view taken on lines 4-4 of FIG. 1.
Figure 8:
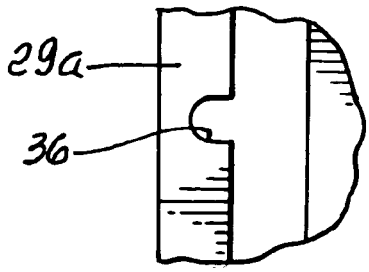
FIG. 8 is a fragmentary plan view taken on lines 8-8 of FIG. 6.

When the stand is in upright position, the releasable connection part or parts 34*a* on brace 32 fit in a slot 36 defined by base part 29*a* as seen in FIGS. 6 and 8, whereby the stand is braced in upright condition as seen in FIG. 1. Connection tightening handle 34*b* is seen in FIGS. 2-4.

Figure 5:
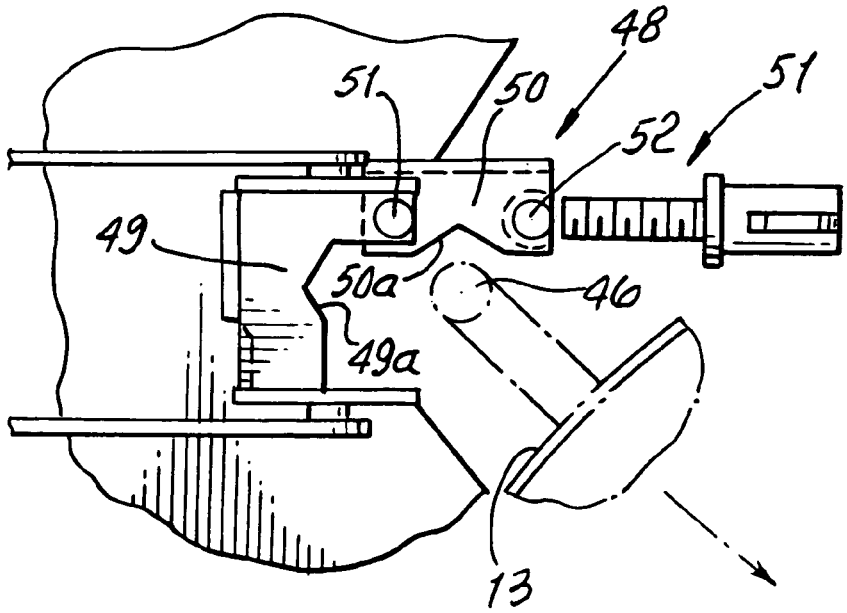
FIG. 5 is an enlarged fragmentary view showing a portion of FIG. 1, showing release of mounting to a percussion instrument.

A holder, as at 40 is carried or provided on upper extent of the stand to releasably hold the percussion instrument 13 such as the cow bell shown, in upright position to be struck by the beater 14, as referred to. The holder may, with unusual advantage, includes a knurled vertical shaft 46 adjustably positioned vertically within or adjacent the stand, which may be hollow. A clasp 48 to hold the shaft in selected vertical position includes a fixed jaw 49 on the top of the stand, and a movable jaw 50 swingable about a vertical pivot axis 51, as seen in FIG. 5. When jaw 50 is swung open, as seen in FIG. 5, it allows vertical adjustment of shaft 46 the shaft 46 being released, and when the jaw 50 is closed as seen in FIG. 4, it grips the shaft to lock it in selected vertical positions. See jaw V-shaped surfaces, 49*a* and 50*a* to clamp the knurled shaft. A jaw locking element 51 swings about an axis 52 on 50, between positions seen in FIGS. 5 and 4 to lock or release the jaw 50.

A lateral shaft 56 connected to vertical shaft 46, mounts a percussion instrument 13, such as the cow bell. Such mounting includes a bracket 58 connected to 13, and having a hole or holes to pass 56, which is clamped by a part 60 in response to turning of handle 61. Part 60 may be screw thread connected to the bracket. Accordingly, the instrument 13 is releasable from the lateral shaft 56, for transport.

Angled holding screws 80, thread connected to the base as at 81, are adjustable to adjust the position of sharp tip 80*a* of the screws, to grip the floor surface, to position apparatus 10, and hold it against movement away from beater apparatus 11. Support feet for apparatus 10 are shown at 63 in FIG. 3.

Space is provided at 70 between side flanges 71 of the base, for reception of brace legs between such flanges, in collapsed position as seen in FIG. 7. In that view, pivot connection 33 has shifted toward the left, i.e. proximate the slot 36.

Figure 9:
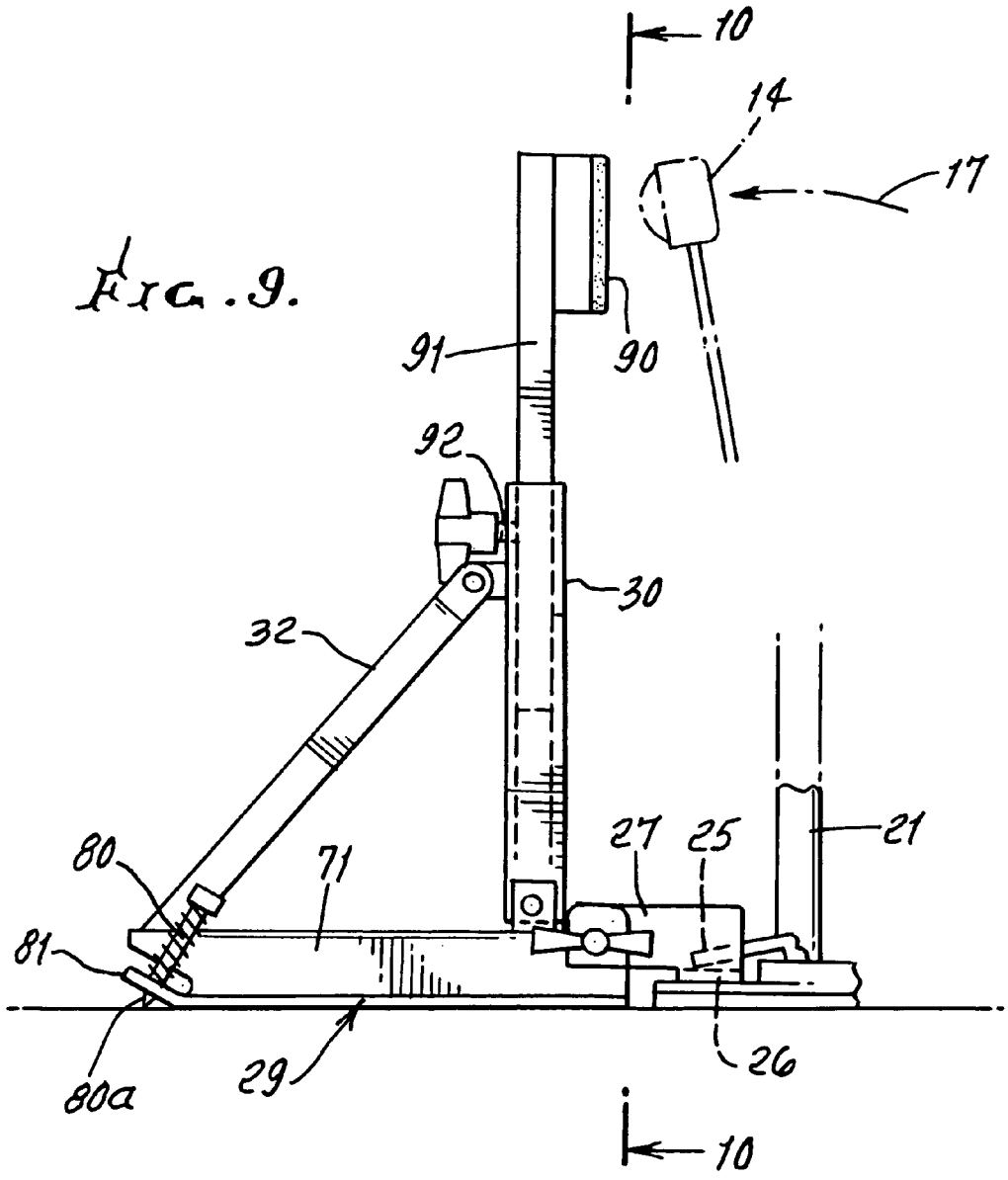
FIG. 9 is a side elevation of percussion instrument support apparatus, like FIG. 1, except that a modified percussion instrument is shown.
Figure 10:
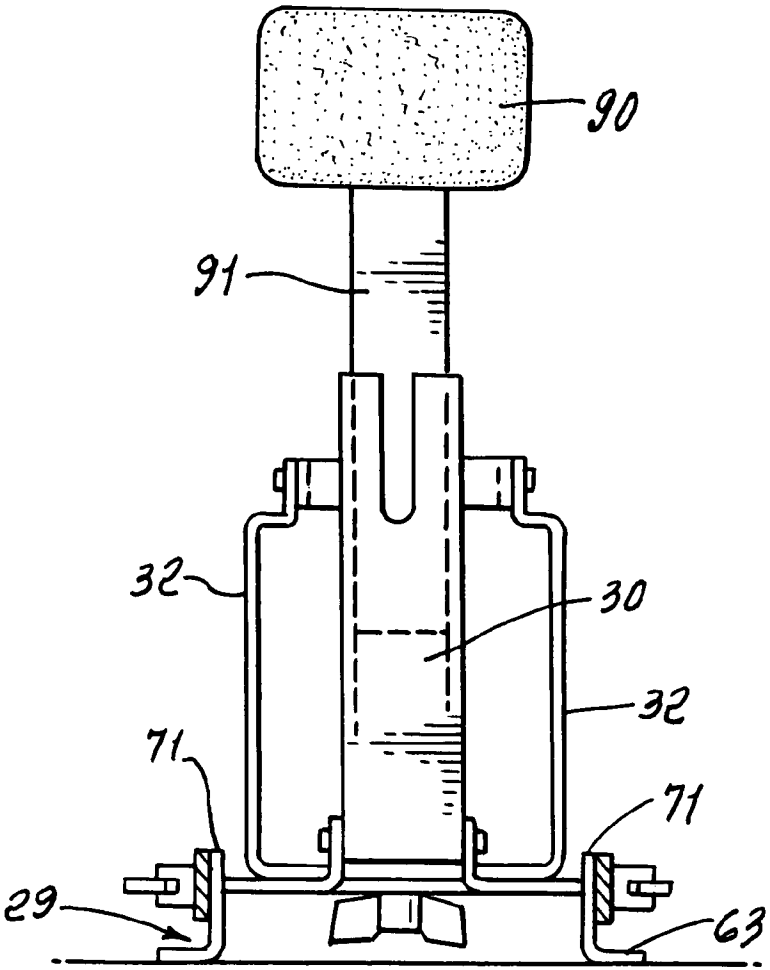
FIG. 10 is an elevation taken on lines 10-10 of FIG. 9.

FIGS. 9 and 10 show drumming plastic pad 90 carried by upper extent of the stand 30, and facing toward the beater 14. A vertical bar 91 carries the pad, and means is provided for adjustably connecting the bar to the stand, to accommodate vertical adjustment of the bar and pad. See for example, vertical sliding of the bar in the hollow stand, and set screw 92 carried by the stand to be tightenable against the bar, to hold it in position.

Figure 11:
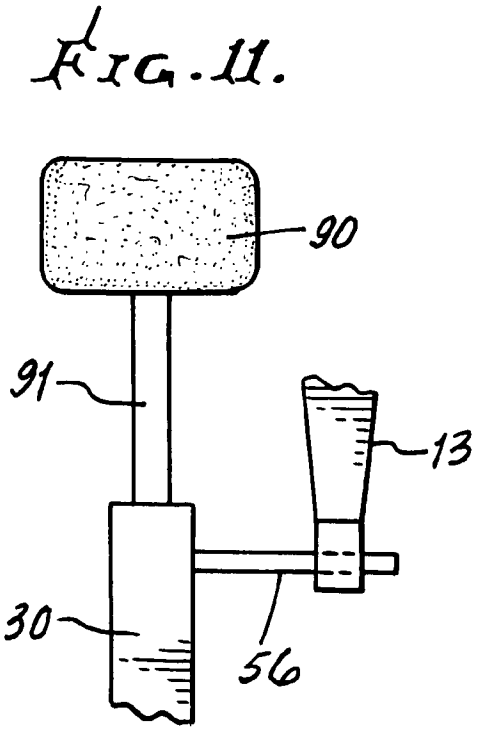
FIG. 11 is a schematic showing simultaneous support of two percussion instruments on the stand shown in FIG. 1.

FIG. 11 shows simultaneous adjustable support of both the practice pad 90 and cow bell 13 on the swingable stand 30.

I claim:

1. Percussion instrument support apparatus, comprising in combination a) a base, b) an upright stand pivotally supported on the base to a first position, c) a brace releasably connected to the base at a second position offset from the first position, the brace pivotally connected to the stand, d) whereby when the stand is swung to down position relative to the base, the brace is released from the base and is swung oppositely to a down position relative to the base, e) and including said percussion instrument in the form of a cow bell, and including a holder carried by the stand, the cow bell attached to the holder.

2. The combination of claim 1 wherein the brace and stand extend in side-by-side relation, generally horizontally, in said down position.

3. Percussion instrument support apparatus, comprising in combination a) a base, b) an upright stand pivotally supported on the base to a first position, c) a brace releasably connected to the base at a second position offset from the first position, the brace pivotally connected to the stand, d) whereby when the stand is swung to down position relative to the base, the brace is released from the base and is swung oppositely to a down position relative to the base, the brace and stand extending in side-by-side relation, generally horizontally, in said down position, and wherein the brace has two legs respectively extending at opposite sides of the stand, in said down position.

4. The combination of claim 3 wherein the brace has a releasable connection at an end thereof to releasably connect to the base.

5. The combination of claim 4 wherein the base has a slot to receive said connection.

6. The combination of claim 1 wherein the holder is carried on upper extent of the stand to releasably hold the cow bell.

7. The combination of claim 1 including a foot operated beater positioned to swing and strike the cow bell.

8. The combination of claim 1 wherein said holder includes a strut extending sidewardly from the stand, the cow bell extending in sidewardly offset relation to the stand.

9. The combination of claim 1 including a drumming practice pad carried by the stand.

10. The combination of claim 8 including a drumming practice pad carried by upper extent of the stand.

11. The combination of claim 10 including a bar carrying the practice pad, and means for adjustably connecting the bar to the stand, to accommodate vertical adjustment of the bar and practice pad.

12. The combination of claim 10 including means for adjusting the vertical position of the pad relative to the stand.

13. The combination of claim 1 includes a drumming practice pad adjustably supported by the stand to be removable prior to stand collapse.

* * * * *